United States Patent [19]

Endo

[11] Patent Number: 4,552,515

[45] Date of Patent: Nov. 12, 1985

[54] HANDY TUBE PUMP

[76] Inventor: Tsuyoshi Endo, 53, Kamihonmachidori, Numazushi, Shizuokaken, Japan

[21] Appl. No.: 647,604

[22] Filed: Sep. 5, 1984

[51] Int. Cl.[4] ..... F04B 45/02; F04B 43/06

[52] U.S. Cl. ..... 417/472; 417/480; 417/440; 417/503; 417/511; 137/150; 137/147

[58] Field of Search ..... 137/143, 147, 150, 150.5, 137/151; 417/472, 440, 511, 503, 480; 92/34

[56] References Cited

U.S. PATENT DOCUMENTS

| | | | |
|---|---|---|---|
| 533,683 | 2/1895 | Triller | 137/151 |
| 1,083,228 | 12/1913 | Stuart | 137/148 |
| 1,582,399 | 4/1926 | Aplander | 137/150 |
| 3,549,015 | 12/1970 | Willinger | 97/34 |

FOREIGN PATENT DOCUMENTS

| | | | |
|---|---|---|---|
| 48001 | 1/1980 | Japan | 417/472 |
| 14880 | 2/1981 | Japan | 417/63 |
| 203886 | 12/1982 | Japan | 417/440 |
| 203885 | 12/1982 | Japan | 417/440 |

*Primary Examiner*—William L. Freeh

*Attorney, Agent, or Firm*—Jordan and Hamburg

[57] ABSTRACT

A tube pump for use in pumping a liquid from one place, such as a tank, to another, such as a vessel, the tube pump comprising a first tube for sucking a liquid from a tank; a second tube for allowing the sucked liquid to discharge therethrough; a connecting chamber located in the joint of the first and the second tube, where these two tubes are communicated with each other; a bellows member communicating with the connecting chamber, the bellows member being adapted to be gripped by the user's hand; the bellows member having an opening closable by a valve member; the valve member including a cap having an aperture in its center, and a cover including a stem slidably passed through the aperture, wherein the aperture is airtightly closed by the stem when no force acts on the cover but is opened when the cover is pushed downwards.

1 Claim, 2 Drawing Figures

HANDY TUBE PUMP

BACKGROUND OF THE INVENTION

1. Field of the Invention

The present invention relates to a handy tube pump for use in pumping a liquid from one place, such as a tank, to another, such as a vessel, under pressure provided by a hand-operated bellows member.

2. Description of the Prior Art

Handy pumps made of a plastic tube are known, and widely used for supplying fuel to oil heaters. The tube pump has a suction tube and a discharge tube. The suction tube is inserted in an oil tank at one end, and the discharge tube is inserted in the heater at its terminating end. In addition, the pump is provided with a bellows member communicating with the suction tube and the discharge tube, the bellows member having a small opening at its top. When the oil in the tank is to be sucked, the opening is closed, and the bellows member is gripped in the user's palm several times so that oil is transferred from the oil tank to a heat tank. When the heater tank is filled, the opening is opened. Usually the opening is closed by a cap. The known tube pumps have an internally threaded cap, which is screwed to the bellows member. When the cap is loosened thereby to open the opening, the user must turn the cap by hand. This requires the user to use his both hands, that is, with one hand the bellows member is operated, and with the other the cap is loosened. By loosening the cap, the pressure inside the bellows member is allowed to escape through the opening, thereby stopping the supplying of the fuel to the heater.

OBJECTS AND SUMMARY OF THE INVENTION

The present invention aims at overcoming the problems pointed out with respect to the known tube pumps, and has for its object to provide an improved tube pump capable of operation by one hand.

Other objects and advantages of the present invention will become apparent from the detailed description given hereinafter; it should be understood, however, that the detailed description and specific embodiment are given by way of illustration only, since various changes and modifications within the spirit and scope of the invention will become apparent to those skilled in the art from this detailed description.

According to the present invention, there is provided a tube pump which comprises:

- a first tube for sucking a liquid therethrough;
- a second tube for allowing the sucked liquid to discharge therethrough;
- a connecting chamber located at the joint of the first and the second tube, where these two tubes are communicated with each other;
- a bellows member communicating with the connecting chamber, the bellows member being adapted to be gripped by the user's hand;
- the bellows member having an opening closable by a valve member;
- the valve member including a cap having an aperture in its center, and a cover including a stem slidably passed through the aperture, wherein the aperture is air-tightly closed by the stem when no force acts on the cover but is opened when the cover is pushed downwards.

DETAILED DESCRIPTION OF THE INVENTION

Figure 1:
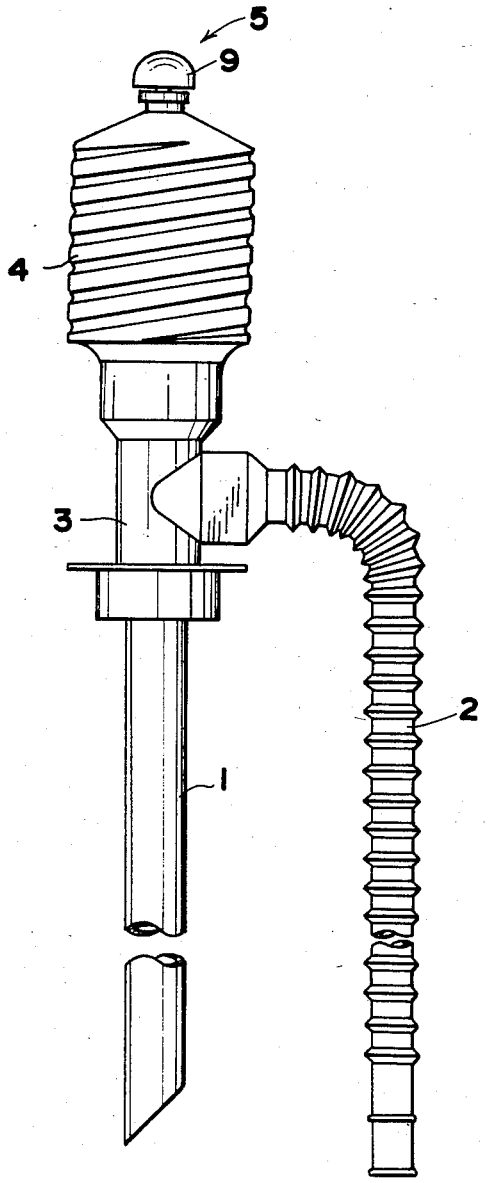
FIG. 1 is a perspective view showing a tube pump embodying the present invention.

Referring to FIG. 1, the tube pump is provided with a suction tube 1 and a discharge tube 2, wherein these two tubes are communicated with each other in a connecting chamber 3. The connecting chamber 3 includes valve members (not shown) which are opened and closed in accordance with the sucking and discharging of fuel. The structure of the valve members is known, and a description of it will be omitted for simplicity.

Figure 2:
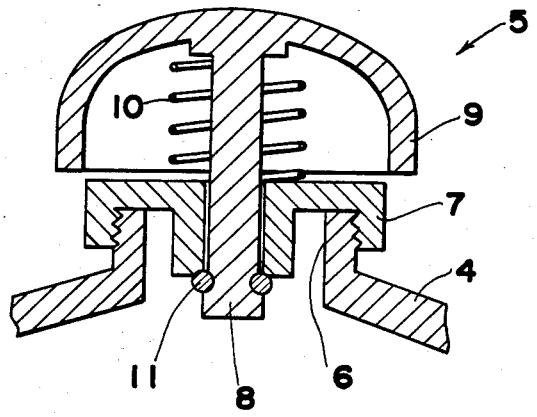
FIG. 2 is a fragmentary cross-section on an even larger scale showing a valve member.

The connecting chamber 3 is communicated with a bellows member 4, whereby the fuel in a tank is sucked through the suction tube 1. The bellows member 4 is gripped in the user's palm to provide a negative pressure therein. The bellows member 5 is provided with a valve 5 at its top end, as shown in FIG. 2. The valve 5 is designed to open and close an opening 6 of the bellows member 4 in the following manner:

The valve 5 includes an internally threaded cap 7 screwed to the bellows member 4, and a stem 8 integral with a cover 9, the stem 8 being spring loaded by means of a spring 10, so as to close the opening 6. The reference numeral 11 denotes a sealing fixed to the stem 8. The cover 9 is designed in the form of a dome so as to facilitate the pushing of it by the user's hand.

In operation, when fuel is supplied from a fuel tank to the heater, the suction tube 1 is inserted in the fuel tank (not shown), and the discharge tube 2 is inserted in the inlet of the heater (not shown). Then the bellows member 4 is gripped several times in the user's palm. The fuel in the tank is pumped through the suction tube 1 to enter into the connecting chamber 3, and supplied from the chamber 3 to the heater through the discharge tube 2. When the tank of the heater is filled, the cover 9 is pushed downwards, thereby causing the stem 8 to lower against the spring 10. In this way the pressure inside the connecting chamber 3 is allowed to escape. The fuel in the section line 1 returns to the tank while the valve member moves from its open to closed positions and thereafter the fuel in chamber 3 flow to the heater tank.

When the cover 9 is pushed, it is operated by the same hand that is used to grip the bellows member 4.

The tube pump according to the present invention is also used for pumping the water in a household aquarium. As a kitchen utensil it can be used for transferring edible oil from a tank to a pan or vice versa. The tube pump is applicable when a relatively small quantity of liquid, such as oil and liquor, is transferred from a tank to a bowl for cooking purpose or any other particular purpose.

What is claimed is:

1. A tube pump for transferring liquid from one place to another place, comprising:

- a chamber,
- a suction tube having a first end connected to the chamber and a second end adapted to be situated in a place where liquid to be transferred is held,
- a discharge tube having a first end connected to the chamber and a second end adapted to be situated in another place where liquid is to be transferred, a bellows member having an opening at an upper end, said bellows member being adapted to be gripped by a user's hand and connected to the chamber to communicate therewith so that when the bellows member squeezed by the hand of the user provides negative pressure to the chamber, liquid is sucked into the chamber through the suction tube, and when the bellows member is squeezed by the hand of the user to thereby provide positive pressure to the chamber, liquid in the chamber is forced to exit from the chamber through the discharge tube, and a valve member attached to the opening of the bellows member, said valve member including a threaded cap securely connected to the opening and having an aperture passing therethrough, a cover having a stem extending from the cover, said stem having an end and a diameter smaller than that of the opening so that when the stem is located in the aperture, an annular space is formed inside the aperture, a seal situated around the stem adjacent to the end thereof, and a spring situated around the stem and located between the cover and the threaded cap to urge the cover upwardly so that the annular space is normally sealed by the seal, and when the cover is pushed by the user against the force of the spring, the inside of the bellows member communicates with atmosphere through the annular space.

* * * * *